US007393435B2

(12) United States Patent
De Melo Guerra

(10) Patent No.: US 7,393,435 B2
(45) Date of Patent: Jul. 1, 2008

(54) INJECTION CHARGING SYSTEM IN DELAYED COKING DRUMS

(75) Inventor: Eduardo Cardoso De Melo Guerra, Petrópolis (BR)

(73) Assignee: Petroleo Brasiliero S.A., Petrobras (BR)

( * ) Notice: Subject to any disclaimer, the term of this patent is extended or adjusted under 35 U.S.C. 154(b) by 581 days.

(21) Appl. No.: 11/012,260

(22) Filed: Dec. 16, 2004

(65) Prior Publication Data

US 2005/0211540 A1 Sep. 29, 2005

(30) Foreign Application Priority Data

Mar. 25, 2004 (BR) ..... 0400769

(51) Int. Cl.
*B01D 3/00* (2006.01)

(52) U.S. Cl. ..... 202/239; 196/135; 196/155; 208/131

(58) Field of Classification Search ..... 202/239; 196/155, 135; 201/25; 208/131
See application file for complete search history.

(56) References Cited

U.S. PATENT DOCUMENTS

| | | | | |
|---|---|---|---|---|
| 4,634,500 | A | 1/1987 | Elliott et al. | |
| 5,795,445 | A | 8/1998 | Boswell et al. | |
| 6,193,848 | B1 | 2/2001 | Shockley et al. | |
| 7,115,190 | B2 * | 10/2006 | Lah | 201/25 |
| 2007/0108036 | A1 * | 5/2007 | Siskin et al. | 201/21 |

FOREIGN PATENT DOCUMENTS

| | | |
|---|---|---|
| EP | 0 353 023 | 1/1990 |
| EP | 1 236 787 | 9/2002 |

* cited by examiner

*Primary Examiner*—N. Bhat
(74) *Attorney, Agent, or Firm*—Nixon & Vanderhye PC

(57) ABSTRACT

Described is an injection charging system in delayed coking drums (11), comprised of at least two injection pipes (11*a*) connected to the sidewall of a coking drum (1) in its tricone portion, and fed by a circular distributor crown, in order to allow coupling or decoupling of the large lower flange (11*e*) of the coking drum (1) without needing to disconnect the injection system (11) from the pumping and heating system (10).

14 Claims, 4 Drawing Sheets

INJECTION CHARGING SYSTEM IN DELAYED COKING DRUMS

This application is based on, claims the benefit of priority of, and incorporates hereby by reference the contents of Brazilian Patent Application No. PI 0400769-7 filed on Mar. 25, 2004.

SCOPE OF THE INVENTION

The present invention refers to an injection charging system in delayed coking drums, which allows decoupling of the inferior flange of the delayed coking drum without needing to disassemble the charging line of the feed system.

The system is made up of one or more charging lines that access the inside of the delayed coking drum through its sidewall, in the lower tricone portion.

DESCRIPTION OF THE STATE OF THE ART

In the petroleum industry, due to the high economic value of its product, it is common to implement processes aimed at recouping residual material of any substance that still may possess commercial value.

In this way, the petroleum industry has for a long time now developed processes that allow for the extraction of by-products that still possess economic value, except that nonetheless, there still are aggregates within the residue from other processes, such as vacuum sediments, sludge, shale or bitumen.

One of these processes is known in the petroleum industry as delayed coking. It is named in this manner due to one of the stages of the process that takes place in the following way:

A load of heavy hydrocarbons (generally proceeding from other processes), is routed to the oven.

In the oven, the load is heated on coils to a temperature of above 500° C. in order to begin the thermal and chemical reactions.

Since the reactions cannot take place completely inside the coils of the oven, (which can cause irreparable consequences) the load is pumped into drums where they remain in accumulation. These drums work in parallel, in different stages of the coking process. While one receives the load, another is unloaded and cleaned.

Inside the drums, the reactions that began in the oven continue in the actual coking process of the accumulated load at a temperature close to 500° C.

This is how the release of vapors and gases begins. These vapors and gases will be collected on the top of the drum, which in the reality are vapors of light hydrocarbons proceeding from the residual hydrocarbons of other processes.

Once the thermal and chemical reactions are finished and consequently the release of gases and vapors having commercial value, the drum is filled with a single solid block of genuine coke. In this stage, the drums receive an injection of water vapor, with which the equipment begins to cool down and which also promotes a final removal of hydro-carbons by permeating the pores of the coke.

Right afterwards, water is injected into the drums so that the residue and the equipment may cool down faster.

Once the drums and the coke load have finally been cooled down, the water is released.

The flanges at the top and the base of the drum open and through the upper opening, using a water jetted boring process; the coke block is broken down into small pieces.

The coke, now in pieces, is removed from the drum's lower opening, and

Another cycle is started.

Therefore, this process is called delayed coking, because heavy hydrocarbons are heated in an oven, where reactions are initiated, but the actual process of hydrocarbon coking itself is achieved with delay in a drum.

However this process, widely used in the petroleum industry, is very slow, submits equipment to great forces and moreover, presents a very high risk of accidents for its operators, all because of the characteristics of the delayed coking drums' construction and due to its method of operation.

Two structural aspects of the delayed coking unit equipment are inherent and common to any type of delayed coking process in any and all applications: The arrangement of the drums' construction with its respective accessories, and the fact that the hot material as well as the water for cooling is injected into the interior of the drum through its lower portion and in a centralized manner.

These two aspects are a result of the need to design coking drums with structural components that resist the severe forces to which they are subjected during the process cycle.

Regarding the first aspect, the manner in which the coking drums and their respective accessories are constructed (even though there are differences of design adopted by various petroleum industry companies), they always retain a cylindrical format and have two main openings: one in the top and another one in the base of the coking drum, however this last one, is approximately at the height of a human being as measured from the operation floor.

The cylindrical format is used due to the great mechanical forces to which the drum is subject: Internal pressure, stress created by the very weight of the material deposited on the inside of the drum, such as the hydrocarbon load plus the water, and stress created by the great actions of expansion and contraction that result from the temperature of the process reaction and from the abrupt cool-down caused by vapor and water.

The reason two large openings are needed is to accommodate the discharge of the coke. After the cooling stage, the remaining coke residue is converted into a single solid mass, and must be drilled out from the top of the drum to the bottom, so that it can be broken down into smaller pieces and removed through the bottom opening of the drum.

The lower opening of the drum is generally located at the approximate height of a human being as measured from the operation floor, because the steps to open and close the drum are usually carried out manually or semi-automatically, needing some type of interaction from a technician.

Regarding the second aspect that is commonly found in the manner in which this type of equipment is constructed, is the position of the feed line in the center of the flange that seals the lower drum opening. This feed system is generally used to inject the warm hydrocarbon load and later to inject water and water vapor for cooling.

This manner of construction has always been used in the delayed coking process up until the present time, in order to even out the forces of rapid expansion to which the coking drum is submitted when the warm hydrocarbon load is injected and the posterior stress of contraction when water and water vapor are injected for cooling.

Many documents may be cited that give examples of the use of this type of configuration for load injection: Documents U.S. Pat. No. 4,634,500 dated Jan. 6, 1987 and U.S. Pat. No. 5,795,445 dated Aug. 18, 1998, make diagrams of how the material enters into the bottom of the drum and try to resolve the problems of accumulated stress, controlling the flow rate of water injection for cooling. Documents U.S. Pat. No. 6,193,848 dated Feb. 27, 2001 and EP1.236.787 of Sep.

4, 2002 also use injection into the bottom of the drum, but they try to resolve the same problems with assembly techniques using structural plates in the coking drum.

Technical literature reveals that injecting the warm hydrocarbons and water for cooling into the sidewall of the drum has already been tried in the past. But the coking drums' walls were subjected to great variations of stress due to the injection of the hot load at one lateral point, followed by the injection of water for cooling through the same feed point at the end of the process. These differences in stress caused a great shortening of the useful life of the equipment and even accidents due to accumulation of deformations and residual stresses.

Also, because access and/or discharge of the load and discharge lines must be positioned in the lower area of the drums, the industrial plants that produce this equipment place all the warm hydrocarbon charging and discharging lines, vapor lines and hot water lines very close to ground floor level.

All these structural details which are customarily used in any delayed coking plant, produce several operational and security problems.

Currently, each coking cycle goes through a crucial stage: The lower flange opening, which is made of steel and measures approximately 2 meters in diameter.

The lower flange of the drum must be disassembled to allow the discharge of the coke, but as the charging line, due to the necessities of the design, it must have access to the lowest and most central part of the drum, that is to say to the center of the bottom flange, making it obligatory that a stretch of the charging line be disassembled together with the lower flange.

This operational characteristic generates at least two problems:

The first problem is the need for a team of operators to manually disassembly and dismount the two flanges, because the flanges are connected by means of sheaths secured with nuts. Therefore, this operation generates great risk for accidents, since this is an extremely hot area and is subject to several mechanical forces and consequently is at risk for spills.

The second problem is the existence of two weak points. Because there are two flanges that are assembled and disassembled in each cycle, which are subject to failure, and which will always be points requiring special attention on the part of the technician with tests and constant maintenance, since these points are vulnerable.

All of this represents lost time in each cycle and the need to maintain a specialized and trained team for this type of work.

Currently, in an effort to try to minimize these risks, many petroleum industries have adopted a system of setting the flanges that uses automatic or semi-automatic opening devices. Some have adopted this system of setting the flanges only in the case of the large lower flange of the drum; others also use it on the small flange of the charging line.

An example of an attempt to minimize the difficulty in manipulating the large lower flange with follow-up of the charging line is contained in document EP 353.023 dated Jan. 31, 1990.

Despite the efforts of the petroleum industry to minimize the need for human proximity to these forces in this area, by searching for a totally automatic system to set and move this section of the charging line that contains the two flanges and that together comprise the critical elements of the equipment, greater attention continues to be focused on quality control of these operations, which demands that more attention and test be performed before beginning each cycle.

The fact that the charging line has these two connections (even if they did not have to be assembled and disassembled constantly in approximately 24-hour intervals), would present tangible points requiring attention and care, because being a line that works simultaneously with warm hydrocarbons at a temperature close to 500° C. plus the water for cooling, this line and all its elements are subject to great mechanical forces resulting from expansion and contraction of the tubing.

Another disadvantage resulting from the need to open the lower flange is that in this stage of the delayed coking cycle, when automatic methods of opening and closing these flanges is applied, much time is lost. And since the production of a heating oven for hydrocarbons that will then go inside the drums to continue the reactive process continues, any lost time in restarting a new coking drum cycle, means a loss in production, or will require a plant having a greater number of available drums, and therefore a greater investment.

Other common problems in the delayed coking plants are the high degree of risk involved with movement of operators in the area, and the restriction of access to equipment and tools in order to carry out tasks below the drums.

The origin of these problems is that the various high temperature charging lines must be installed at the ground floor level, so that there may be an access point at the lowest point on the coking drum, which in turn, needs to be around the height of the operators.

Consequently, this set of warm hydrocarbon charging lines, water vapor lines, and hot water lines at the ground floor level, cause a congestion of lines in the coking plant, creating several points of potential risks of accident to the technicians that must perform tasks in this area where the bottom section of the drums are located.

At the same time, this congested arrangement of lines also restricts access to the heavy equipment that aids in operational tasks and system maintenance, such as connecting, detaching, and transferring the lower flange and its accessories. Purpose of the Invention The present invention aims to provide a way to eliminate the need for removing a section of the charging line in every coking cycle and consequently handling the connecting flanges.

This method, was built to comprise a injection charging system in delayed coking drums, and is economically viable and provides for a reduction in operational risks, while at the same time providing for drum design requirements so as to conserve uniformity in the heating or cooling of its structural elements throughout the coking cycle stages.

Other objectives that the injection charging system in delayed coking drums (object of the current application), proposes to accomplish, are:

To improve the arrangement of the bottom section of the drums, with adequate space for the technicians to move. This objective is accomplished by reworking the position of the hydrocarbon charging lines, as well as vapor and water cooling lines, from their traditional position at floor level to a higher level, above of the heads of the operators.

To open up useful space giving access to equipment at operation floor level under the bottom section of the drums.

To eliminate risk of accidents, especially of burns sustained by the operators who pass under the coking drum.

To eliminate the inherent risk of accidents in the operation that opens the bottom flange or the charging line flange.

To eliminate the risk of spills caused by the constant handling of the flanges and joint seals.

Elimination of the need to assemble and disassemble flanges during each cycle, also reduces the need to constantly test and maintain these points that are considered weak.

To eliminate the risk of spills from the large lower flange due to displacements arising from the expansion and contraction of the charging line.

Permit simplification of the removal cart and transport of the large lower flange in facilities provided with this equipment.

Provide for a more economic new installation, with a lower cost equipment design, because its structural elements will not be subject to mechanical forces as great as the current technique requires, allowing a plant design using cheaper equipment and materials.

Elimination of the need to remove a group of heavy and large items during each and every cycle, which permits an operational time gain, and consequently a very great reduction in the coking cycle time.

It may be installed in new coking plants, as well as in plants presently in operation.

SUMMARY OF THE INVENTION

The present invention refers to an injection charging system in delayed coking drums made up of the orderly fusion of known elements of the technique, mounted in the lower conical portion of the coking drum.

The new system allows the decoupling stage of the delayed coking drum's lower flange to be carried out without needing to disassemble the feed system's charging line, as well as transferring all charging lines to a height above that of a human being in relation to the operation floor.

The system of injection into delayed coking drums basically include the following elements: Injection pipes, refractory cover, distributor crown with an access flange and a large flange, including the following assembly array:

a minimum of two identical injection pipes with one end connected to the lower conical portion of the coking drum wall. The injection pipes are connected to the coking drum at an angle ($\alpha$) other than 90° in relation to its vertical axis and with an equal angular distance ($\beta$) between the successive injection pipes. All the pipes are set at a minimum height (h3) in relation to the lower opening;

one refractory cover covers the portion of the injection pipe closest to the coking drum wall;

the other ends of the injection pipes are connected fluidly to a distributor crown, in an open circular format, that in turn has one end closed and the other with an access flange;

a large blank flange (removable) is located in the coking drum's lower opening.

BRIEF DESCRIPTION OF THE DRAWINGS

The invention will now be presented at greater length, together with the related illustrations below (as an example only), which are included with the present report, of which they are an integral part, and in which.

DETAILED DESCRIPTION OF THE INVENTION

The present invention relates to an injection charging system in delayed coking drums, developed mainly to gain operational time in the delayed coking process and to prevent risk of accidents on the work platform.

Figure 1:
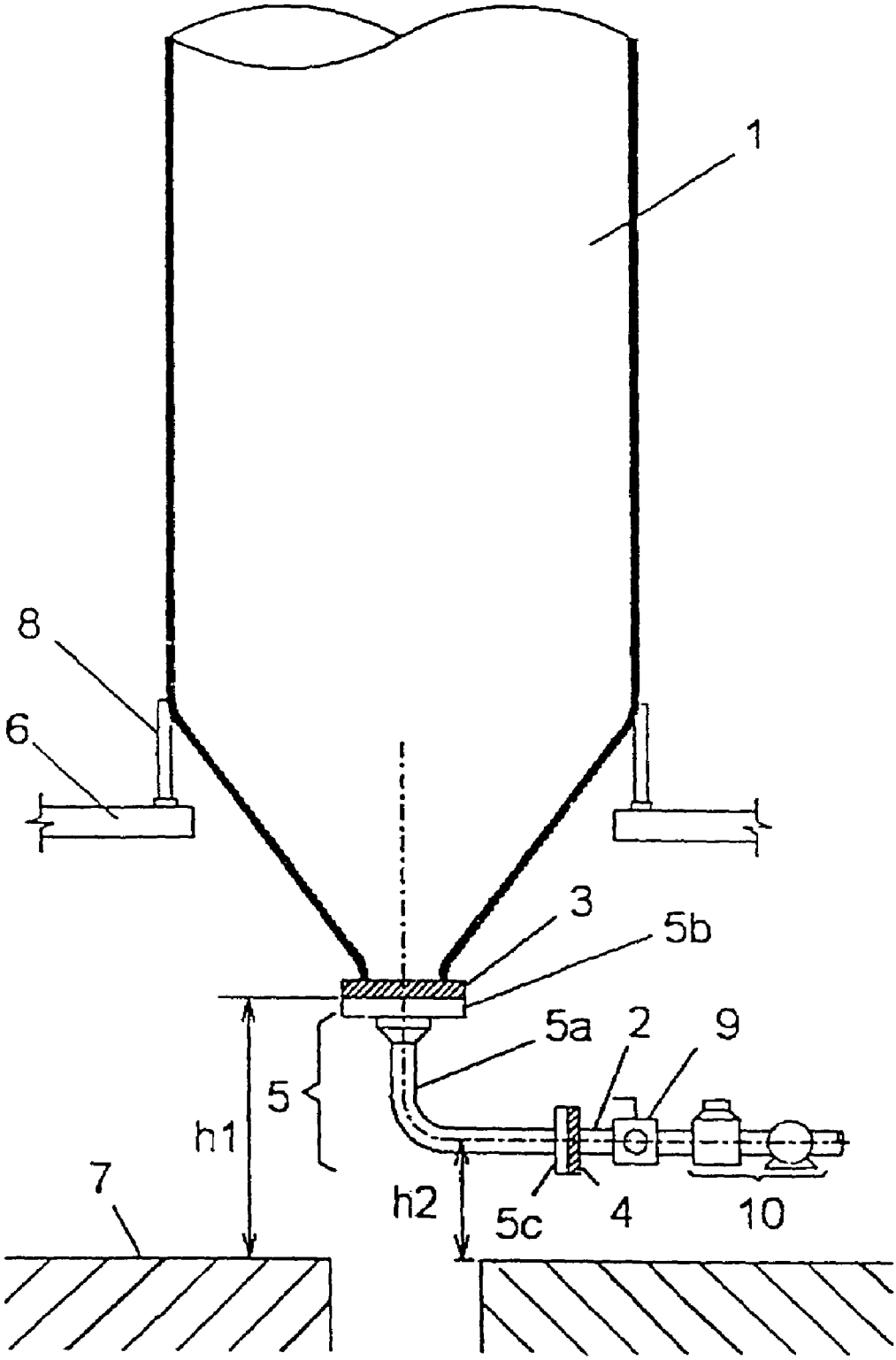
FIGURE 1 PRIOR ART
FIG. 1 shows a common arrangement used in the state of the technique.

FIG. 1 shows a general and simplified view of a common implementation of the current technology in use, where the typical elements of a delayed coking plant can be seen.

A pumping and heating system (10) consisting of a pump and coke oven that will receive the hydrocarbon load that will be pumped and heated in one uninterrupted process.

Since the pumping and heating process of the hydrocarbons is continuous, but the process of delayed coking that takes place inside the coking drums is by batch, normally the pumping and heating system (10) operates with more than one drum, and generally in pairs. While a coking cycle is taking place in one drum, another drum is being loaded to start another cycle.

Thus, after the temperature of the hydrocarbons has reached a temperature of above 500° C., they are routed through a charging line to a distributor valve (9). The distributor valve (9) selects a charging line (2) of a coking drum (1) that is ready to start a delayed coking cycle.

This requires that several drums operate in parallel together with only one pumping and heating system (10) causing a plant to be congested with several charging lines (2), for hot water and water vapor, not represented in order to maintain simplicity in the drawing.

However, in FIG. 1, you can see that the cylindrical coking drum (1) with a conical lower section is optionally supported by shoes (foundations) (8) or is directly supported on a sustaining floor (6). This sustaining floor (6) keeps the lower opening (3) of the drum (1) at the level (h1) of the operation floor (7), which allows the operators to have easy and fast access to handle the lower opening (3). Consequently, the charging lines (2) and their accessories form a net right at the level (h2) of the floor (7).

At the end of each drum cycle (1), the operators must detach the coupling pipe (5) from the lower opening (3), and the small flange (4) of the charging line (2). This coupling pipe (5) is made up of three basic steel elements: A curved section (5*a*) that it is welded to a lower flange (5*b*) and to a charging flange (5*c*).

The lower flange (5*b*) has a diameter of approximately 2 meters and the charging flange (5*c*) has a diameter of approximately 0.4 meters. Consequently, to carry out the operation of coupling and decoupling the coupling pipe (5), a cart with hydraulic cylinders is used (not shown in the figures) that it is moved on tracks until positioned under the lower opening (3).

After the coupling pipe (5) is duly supported by the cart, the operators remove the elements that fasten the lower opening (3) to the inferior flange (5*b*), and the small flange (4) to the charging flange (5*c*). These fastening elements generally are sheaths secured with nuts, but currently they have tried to substitute them with automatic or semi-automatic hydraulic devices.

Whatever the chosen method might be, there is always the need to:

the presence of at least one or more technicians in this risky area, to perform the operation or to carry out tests;

loss of time in assembling, disassembling and handling a large and extremely heavy item, which has been made even heavier with the respective fastening systems used;

two points of connection that need constant maintenance with periodic joint changes.

It must be pointed out that the joint used to seal the union between the small flange (4) and the charging flange (5*c*) is expensive, and cannot be re-used.

Figure 2:
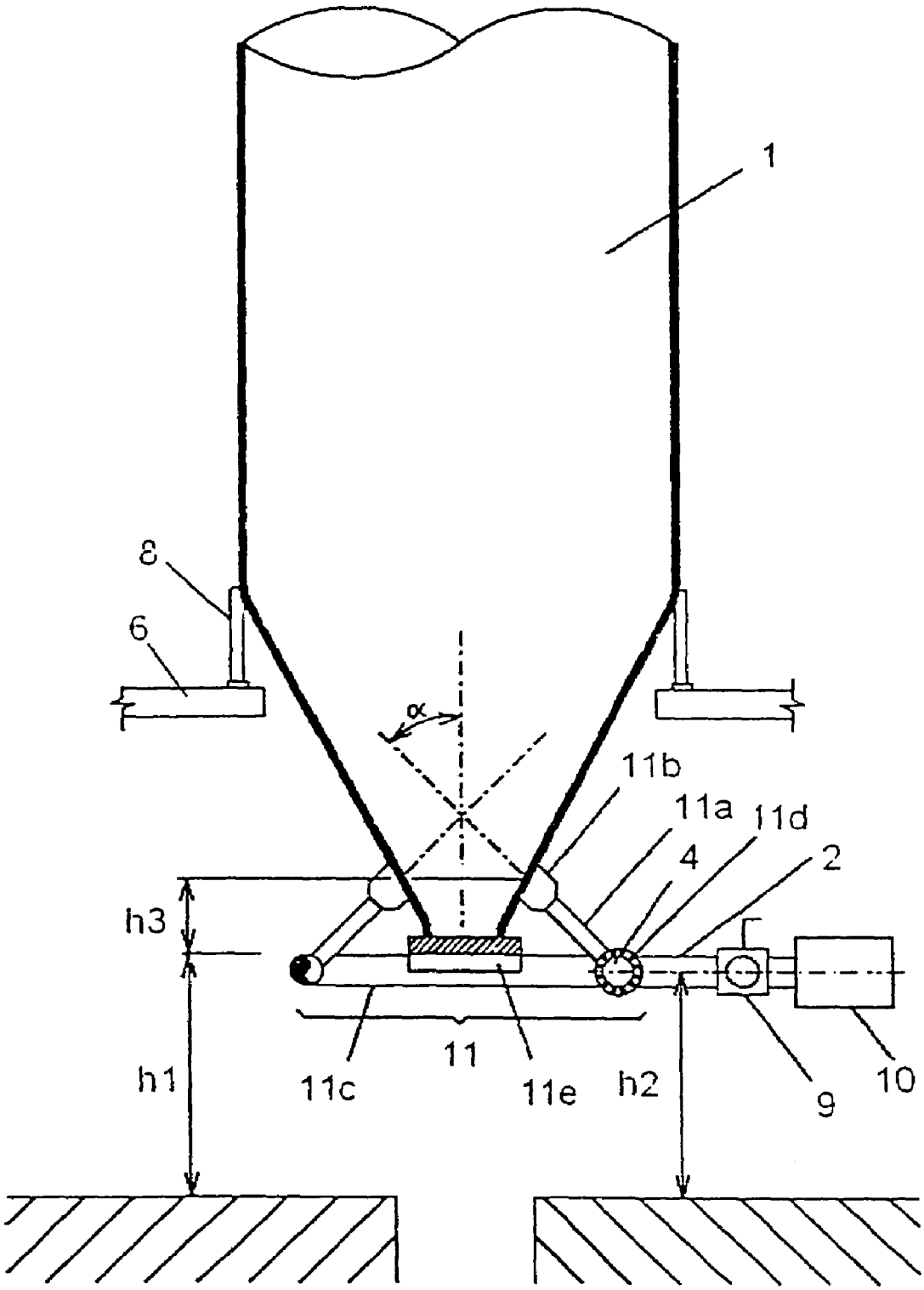
FIG. 2 shows a general side view of the injection charging system in delayed coking drums.

FIG. 2 shows a general lateral view of a prototype of the invention, used to perform the injection into a coking drum (1) of a load of warm hydrocarbons or water for cooling, during a delayed coking process cycle.

The fundamental principle of the delayed coking injection system (11), which is the object of the current invention, consists of transferring by injection a hot or cool load, from the center of the lower flange (5*b*) to the lower conical portion of the coking drum wall (1), with a minimum number of two opposing access points at an access angle (α) other than 90° in relation to the vertical axis of the coking drum (1). It is known that injection of both the hot material and water for cooling into the wall of the coking drum (1) has already been tried in the past; however this injection was done at a 90° angle in relation to the vertical axis of the coking drum (1) and at one single point.

This practice was shown to be inefficient, because it generated an extremely high temperature differential between the opposite sides of the coking drum, causing several problems, such as:

Ovalization of the coking drum (1), due to the thermal stresses acting at different rates inside the drum, ending up with imperfections in the material.

Great mechanical forces upon the shoes (8) of the coking drum and between the drums and the sustaining floor (6).

Since that period of time, due to the systematic imperfections in the delayed coking drums, the practice of injecting the hot material and the water for cooling into the lower central portion of the coking drum was adopted, thus preventing the various problems of thermal stress coming from an uneven deposit of the hot material into the interior of the coking drum and/or from uneven cooling due to the lateral injection of the water for cooling.

We have already experimented with injecting both the hot and cooling materials into the wall of the coking drum (1) made at a 90° angle in relation to the vertical axis of the coking drum (1) and at one single point. But the results have not been shown to be reliable and satisfactory which is what has brought us to the present configuration:

The delayed coking injection system (11), which is the object of the current invention, is provided with the two following elements:

Two steel pipes with access to the wall of the coking drum (1) in its lower conical portion. These pipes are called injection pipes (11*a*). The delayed coking injection system (11) must be provided with at least two injection pipes (11*a*). The more pipes provided to the delayed coking injection system (11), fewer stress differentials will affect the coking drum wall (1). The injection pipes (11*a*) may be laid out in a straight or curved line, and always must access the coking drum (1) at an angle (α) other than 90° in relation to its vertical axis.

A covering of refractory material, simply referred to as a refractory cover (11*b*). The refractory cover (11*b*) covers the portion of the injection pipe (11*a*) closest to the coking drum wall (1), and functions to protect weld between these two elements from sudden changes in temperature.

A distributor crown (11*c*) made of a steel pipe in an open circular format that fluidly links all the injection pipes (11*a*).

One of its ends is closed and the another one is provided with an access flange (11*d*). This flange is the delayed coking injection system's (11) link to the charging line.

The option to locate the access flange (11*d*) in any another section of the distributor crown (11*c*) exists. If this option is chosen, the two ends must be closed.

The perimeter of the distributor crown (11*c*) is long enough to link all the injection pipes that make up the delayed coking injection system (11).

A blank flange, called the large flange (11*e*). This flange (removable) closes the lower opening (3) of the coking drum (1), where a linking pipe (5) was located on the old injection system, if fixed.

In reference to FIG. 2, several advantages offered by the object of this invention may be seen, such as:

The distance (h2) between the operation floor (7) and the charging line with its accessories is equal to or longer than the distance (h1) between the floor (7) and the lower opening (3). This new configuration of the delayed coking plant makes free access possible for technicians, not only to the area under the coking drum (1), but also to its surrounding area, because the entire charging line system and its accessories are installed at a level higher than the height of human being, eliminating any risk of accidents.

This new space also makes new areas of access possible for the carts used to support and maneuver the closing flange of the lower opening (3) of the coking drum (1), that in the configuration of the previous technique were extremely restricted.

Another advantage, which may be easily seen by comparing FIGS. 1 and 2, is that a piece that was previously linked to the coking drum's (1) lower opening (3), made up of a lower flange (5*b*), a curved section (5*a*) and a charging flange (5*c*) welded together, that was a very heavy piece in format difficult to handle, requiring carts or devices of complex technology.

With the implementation of the delayed coking injection charging system (11), closing the lower opening (3) only uses the large flange (11*e*), which is much lighter and has a much simpler format in comparison to the old method of closing.

This new configuration for closing requires less technique in its manipulation, and consequently much simpler carts and/or devices. Even so, no matter which system of setting the flanges (manual, semi-automatic or automatic) chosen, the time required for the operations of assembly or disassembly will be much faster, because besides being a much simpler piece to handle, operations are carried out on a single flange, the large flange (11*e*).

But the main advantage consists in the link between the delayed coking injection system (11) and the charging line (2), which is now permanent. This permanent link eliminates the risk of errors due to the successive operations of assembly and disassembly that were necessary before. It also drastically reduces the amount of attention directed toward this point during pressure tests performed before every delayed coking cycle.

Production cost is lowered, because it eliminates the very high cost of maintenance required to change the joint seal between the charging line (4) and the access flange (11*d*), that with the previous configuration was necessary at least once every cycle.

All of these advantages together, greatly reduce the time a coking drum is in operation, which allows delayed coking plant designs to be simpler and to have greater productivity than plants in existence now.

Figure 3:
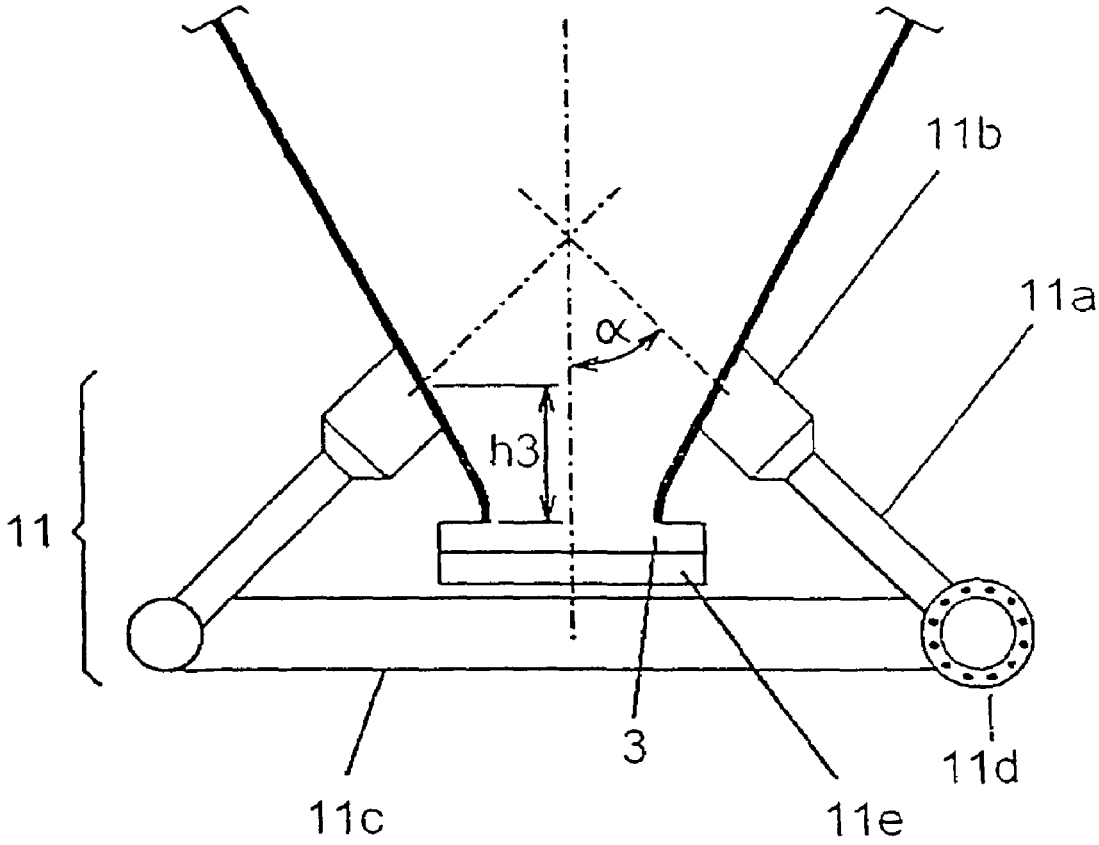
FIG. 3 shows a detailed side view of the charging system in delayed coking drums.

FIG. 3 shows the delayed coking injection system (11) in detail.

In this figure, the angle (α) between the axis of the injection pipe (11*a*) and the vertical axis of the coking drum (1) is shown. This angle must be other than 90°, and must be less than 90° in relation to the base of the coking drum (1), generating a charging injection in the direction of the top of the coking drum (1). Or it may be greater than 90°, generating a charging injection in the direction of the bottom of the coking drum (1). The angle (α) may be between 10° and 89° and between 91° and 120°, preferably between 25° and 35° and 100° and 110°.

Another detail that can be seen in FIG. 3 is the connection between the injection pipes (11*a*) and the coking drum wall (1), that must be provided at the lowest possible height (h3), between the lower opening (3) and the injection pipe axis (11*a*). The lower the height (h3), the lower the thermal stress differentials acting upon the coking drum (1) will be.

However, what it will basically determine this minimum height (h3) will be the care required due to the technical condition of the weld within the angle between wall of the drum (1) and the injection pipe (11*a*). These conditions vary in accordance with the angle of the conical portion of the coking drum (1) where the weld will be performed and the angle (α) where the charging injection will be carried out. Another factor that influences the minimum height (h3) is the choice of device design used for automatically opening the large flange (11*e*), since minimum distances exist that must be taken into consideration between the welds as well as how to accommodate thermal insulation.

Figure 4:
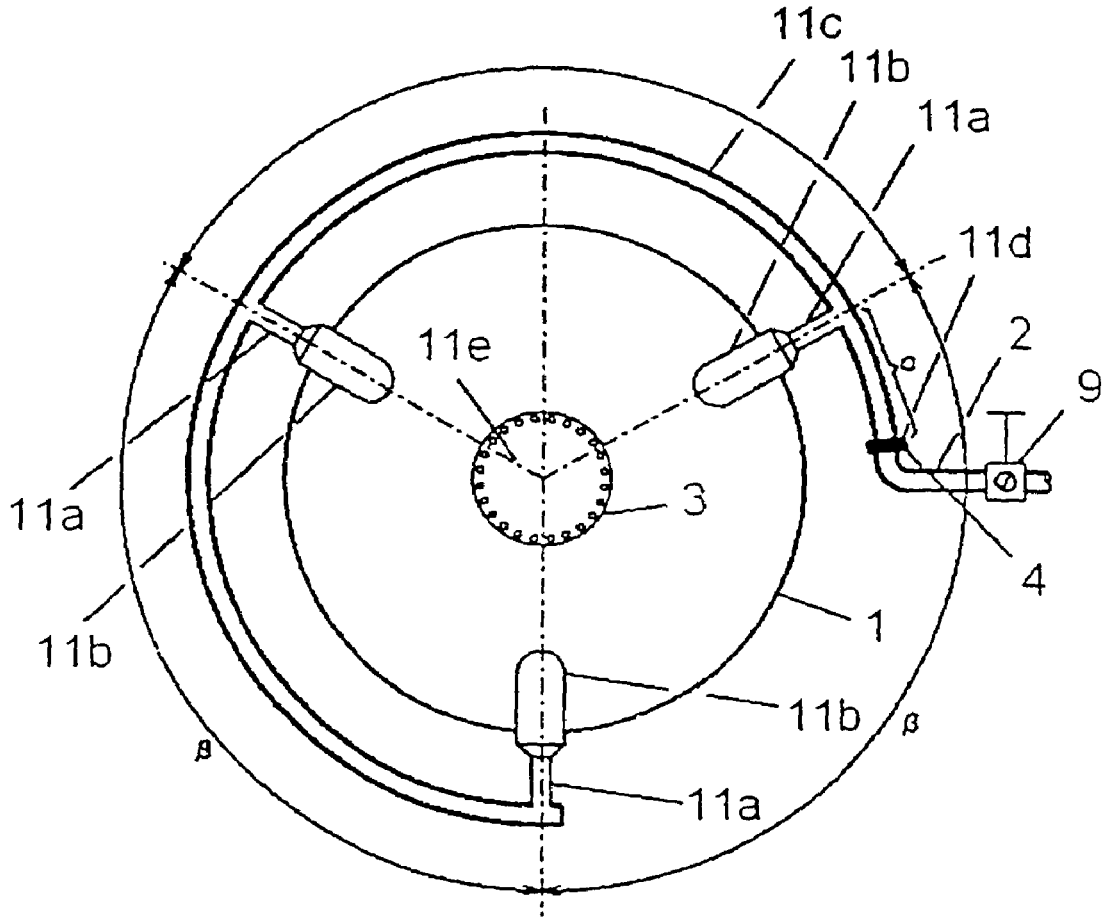
FIG. 4 shows a bottom view of the charging system in delayed coking drums.

FIG. 4 shows a view of the bottom of the delayed coking charging injection system (11), and allows the open circular format of the distributor pipe to be seen (11*c*).

In this prototype, the delayed coking charging injection system (11) in question is provided with three injection pipes (11*a*). It is important to mention that no matter what quantity of injection pipes (11*a*) are chosen for the design, the distribution between them must be equidistant around the center of the coking drum (1). Thus, a design condition of the delayed coking injection system (11) is that the angles (β) between the injection pipes (11*a*) must always be equal.

In this figure, it can also be seen that the configuration of the delayed coking injection system (11) allows the mechanical forces, due to expansion of the charging line (2), to be better absorbed since the access flange (11*d*) is located on the end of a section (α) of the distributor crown (11*c*), on the overhang measuring between 0.10 and 1 meter in length.

In another prototype not included in the figures here presented, the charging line (2) has curved access, to any other section of the distributor crown (11*c*) through a branch ending with an access flange (11*d*), also allowing the mechanical forces caused by charging line expansion (2) to be absorbed by this curved section of the charging line itself (2).

These mechanical forces cause many problems in known designs up until now, making it necessary to use stronger and more expensive materials and welds when manufacturing a curved section (5*a*).

It should be pointed out that, in the two structural configurations above described, in the connection between the charging injection system in delayed coking drums (11) and the pumping and heating system (10), the access flange (11*d*) and the small flange (4) are permanently connected.

The invention has been described herein with reference made to its preferred final applications. However, it must be clarified that the invention is not limited to only these applications, and those with technical abilities will immediately realize that alterations and substitutions can be made without straying from the described inventive concept.

LIST OF COMPONENTS (1) Coking Drum
(2) Charging Line
(3) Lower Opening
(4) Small Flange
(5) Coupling Pipe
(5*a*) Curved Section
(5*b*) Lower Flange
(5*c*) Charging Flange
(6) Sustaining Floor
(7) Operation Floor
(8) Shoe
(9) Distributor Valve
(10) Pumping and Heating System
(11) Injection System in Delayed Coking Drums
(11*a*) Injection Pipe
(11*b*) Refractory Cover
(11*c*) Distributor Crown
(11*d*) Access Flange
(11*e*) Large Flange

The invention claimed is:

1. Delayed coking injection system comprising:

a cylindrical coking drum with a conical lower section;

no less than two equal sized injection pipes fluidly connected at one end to the conical lower section of the coking drum wall, said injection pipes being connected to the wall of the coking drum at a minimum height (H3) in relation to a lower opening of the coking drum, and said injection pipes being inclined with respect to horizontal so as to be at an angle of between 10° and 89° or between 91° and 120° in relation to a vertical axis of the coking drum, with an equal angular distance between the successive injection pipes;

the other ends of the injection pipes being connected fluidly to a distributor crown, in an open circular format, that in turn has at least one end closed and the other end provided with an access flange; and a large removable flange located in the lower opening.

2. Delayed coking injection system in accordance with claim 1, wherein the angle falls within the following range: between 25° and 35°, or between 100° and 110°.

3. Delayed coking injection system in accordance with claim 2, wherein the minimum height H3 is as low as possible, and is a function of the care that must be given due to the technical conditions of the welding in the angle between a sloped wall, with a pipe.

4. Delayed coking injection system in accordance with claim 2, wherein the distributor crown is linked to a first of the injection pipes adjacent the one end thereof and the other end of the distributor crown is linked to a last of the injection pipes and is provided with a branch, finished with said access flange.

5. Delayed coking injection system in accordance with claim 1, wherein the minimum height H3 is as low as possible, and is a function of the care that must be given due to the technical conditions of the welding in the angle between a sloped wall, with a pipe.

6. Delayed coking injection system in accordance with claim 1, wherein the distributor crown is linked to a first of the injection pipes adjacent the one end thereof and the other end of the distributor crown stops at a distance beyond a last of the injection pipes, and is provided with said access flange.

7. Delayed coking injection system in accordance with claim 6, wherein the distance beyond the last injection pipe falls within a range of 0.10 into 1.0m.

8. Delayed coking injection system in accordance with claim 1, wherein the distributor crown is linked to a first of the injection pipes adjacent the one end thereof and the other end of the distributor crown is linked to the last injection pipe and is provided with a branch, finished with said access flange.

9. Delayed coking injection system in accordance with claim 1, wherein a refractory cover covers a portion of the injection pipe that is closest to the coking drum wall.

10. Delayed coking injection system in accordance with claim 1, wherein a height H2 between the operation floor and a charging line of the distributor crown with its accessories is equal to or greater than a height H1 between the floor and the lower opening.

11. Delayed coking injection system in accordance with claim 1, wherein the minimum height H3 is as low as possible, and is a function of the care that must be given due to the technical conditions of the welding in the angle between a sloped wall, with a pipe.

12. Delayed coking injection system in accordance with claim 1, wherein the distributor crown is linked to a first of the injection pipes adjacent the one end thereof and the other end of the distributor crown is linked to the last injection pipe and is provided with a branch in any section of the distributor crown, finished with said access flange.

13. Delayed coking injection system in accordance with claim 1, wherein a distance H2 between an operation floor and the distributor crown is equal to or longer than a distance H1 between the floor and said lower opening, said distance H2 being at least the average height of a human being, whereby a risk of accident is reduced.

14. Delayed coking injection system in accordance with claim 1, wherein there are three injection pipes that are placed equally distant in relation to each other and all injection pipes are connected at said minimum height H3 in relation to the lower opening of the coking drum.

* * * * *